US005556259A

United States Patent [19]

Hlavenka

[11] Patent Number: 5,556,259

[45] Date of Patent: Sep. 17, 1996

[54] VORTEX GENERATING FLUID INJECTOR ASSEMBLY

[75] Inventor: Russel L. Hlavenka, Oconomowoc, Wis.

[73] Assignee: Fleck Controls, Inc., Brookfield, Wis.

[21] Appl. No.: 473,566

[22] Filed: Jun. 6, 1995

[51] Int. Cl.[6] ..... F04F 5/00

[52] U.S. Cl. ..... 417/194; 417/171; 417/197

[58] Field of Search ..... 417/151, 171, 417/194, 197

[56] References Cited

U.S. PATENT DOCUMENTS

| | | | |
|---|---|---|---|
| 3,891,552 | 6/1975 | Prior . | |
| 4,210,532 | 7/1980 | Like . | |
| 4,227,863 | 10/1980 | Sommerer | 417/171 |
| 4,298,025 | 11/1981 | Prior . | |
| 4,380,251 | 4/1983 | Weaver . | |
| 4,632,150 | 12/1986 | Gagas . | |
| 4,764,280 | 8/1988 | Brown . | |
| 4,810,170 | 3/1989 | Ide | 417/194 |
| 4,892,463 | 1/1990 | Meyer et al. | 417/151 |
| 5,022,994 | 6/1991 | Avery . | |
| 5,273,070 | 12/1993 | Chili . | |
| 5,341,834 | 8/1994 | Doherty . | |

FOREIGN PATENT DOCUMENTS

| | | | |
|---|---|---|---|
| 154900 | 6/1988 | Japan | 417/171 |

OTHER PUBLICATIONS

Model 9000 Econominder, pp. 8–11 of Fleck Controls brochure Fleck Controls Model 5000 Service Manual, Jan. 1995.

"Water Jet Exhausters and Compressors", Bulletin No. 4–P, Schutte & Koerting Company.

*Primary Examiner*—Charles Freay

*Attorney, Agent, or Firm*—Lee, Mann, Smith, McWilliams, Sweeney & Ohlson

[57] ABSTRACT

A fluid injector assembly for drawing a first fluid into the flow of a second fluid. The injector assembly includes an eductor including an inlet having a plurality of openings, a first outlet port, and a first fluid passage extending between the inlet and the first outlet port. The openings are generally disposed tangentially to the first fluid passage. The inlet is adapted to be placed in fluid communication with the second fluid such that the second fluid flows through the first fluid passage from the inlet to the first outlet port. The fluid injector assembly also includes a throat having an inlet port, a second outlet port and a second fluid passage extending between the inlet port and the second outlet port. The inlet port of the throat is spaced apart from the first outlet port of the eductor forming a gap therebetween. The gap is adapted to be placed in fluid communication with the first fluid. As the second fluid flows through the first passage, the tangential openings of the eductor cause the second fluid to swirl as the second fluid flows through the first fluid passage and to form a vortex in the gap as the second fluid flows out of the first outlet port. The vortex of the second fluid creates a low pressure zone within the gap which draws the first fluid into the gap wherein the first fluid and the second fluid enter the inlet port of the throat and flow through the second fluid passage.

11 Claims, 2 Drawing Sheets

VORTEX GENERATING FLUID INJECTOR ASSEMBLY

BACKGROUND OF THE INVENTION

The present invention relates generally to fluid injector assemblies for drawing a first fluid into the flow of a second fluid, and in particular to an injector assembly which creates a vortex of the second fluid for drawing the first fluid into the flow of the second fluid.

Water treatment devices of the ion exchange type, often referred to as water softeners, typically include a tank having a resin bed through which hard water passes to exchange its hardness causing ions of calcium and magnesium for the sodium ions of the resin bed. Regeneration of the resin bed is periodically required to remove the accumulation of hardness causing ions and to replenish the supply of sodium ions. Regeneration is usually accomplished by flushing a brine solution from a brine tank through the resin bed. During regeneration a fluid such as unconditioned water flows through a chamber in an injector housing to the resin bed. The brine solution from the brine tank is in fluid communication with the chamber of the injector housing. The water flowing through the injector housing chamber draws the brine solution into the flow of the water and into the resin tank to regenerate the resin bed. In small water softeners, the rate of flow of the water through the injector housing is insufficient to begin or sustain the draw of the brine solution from the brine tank into the resin tank. The present invention provides a fluid injector assembly which provides a reliable draw of brine solution into the flow of water at low flow rates of the water.

SUMMARY OF THE INVENTION

A fluid injector assembly is provided for drawing a first fluid into the flow of a second fluid. The fluid injector assembly includes an eductor including an inlet formed by a plurality of openings, a first outlet port, and a first fluid passage extending between the inlet and the first outlet port. The openings of the inlet are arranged generally tangential to the first fluid passage. The inlet may additionally include openings arranged generally axially to the first fluid passage. The inlet of the eductor is adapted to be placed in fluid communication with the second fluid such that the second fluid flows through the openings in the inlet to the first outlet port through the first fluid passage. The injector assembly also includes a throat having an inlet port, a second outlet port, and a second fluid passage extending between the inlet port and the second outlet port. The inlet port of the throat is spaced apart from the first outlet port of the eductor forming a gap therebetween. The gap is adapted to be placed in fluid communication with a supply of the first fluid. The injector assembly includes first and second leg members each having a first end attached to the eductor and second ends which selectively engage the throat to retain the first outlet port of the eductor in spaced relation to the inlet port of the throat and thereby maintain the gap therebetween. As the second fluid flows through the inlet, the tangential openings of the eductor cause the second fluid to swirl as the second fluid flows through the first fluid passage and out of the first outlet port into the gap thereby creating a vortex of second fluid in the gap. The vortex of second fluid in the gap creates a low pressure zone within the gap between the outlet port of the eductor and the inlet port of the throat which draws the first fluid into the gap wherein the first fluid is drawn through the inlet port of the throat along with the second fluid and flows through the second fluid passage.

DESCRIPTION OF THE PREFERRED EMBODIMENT

Figure 1:
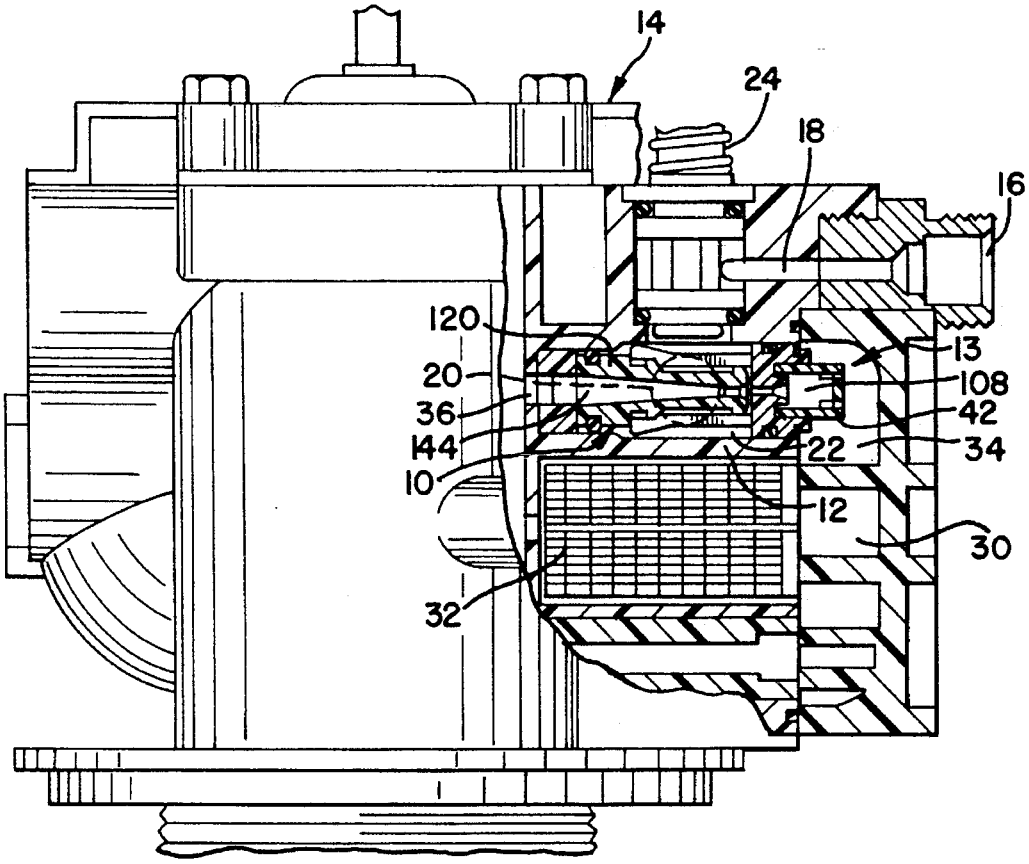
FIG. 1 is a partial cross-sectional view of a control mechanism for a water softener device showing the fluid injector assembly located within the injector housing of the control mechanism.

The fluid injector assembly 10 of the present invention is shown in FIG. 1 installed within the chamber 13 of an injector housing 12. The injector housing 12 is part of a control mechanism 14 of a water treatment system such as a water softener. The control mechanism 14 includes an inlet port 16 which is in fluid communication with a brine tank (not shown). A fluid passage 18 extends between the inlet port 16 to an outlet port 20, illustrated in the dotted lines in FIG. 1, formed in the injector housing 12. The outlet port 20 provides fluid communication between the fluid passage 18 and a central chamber 22 formed within the injector housing 12. A valve 24 may be placed in fluid communication with the fluid passage 18 between the inlet port 16 and the outlet port 20 to selectively open or close the fluid passage 18 as desired. A first fluid, such as a brine solution, flows through the inlet port 16, through the valve 24 and outlet port 20, into the central chamber 22 of the injector housing 12.

The control mechanism 14 also includes a fluid passage 30 which extends through a perforated screen 32 into an outer chamber 34 formed within the injector housing 12. A second fluid, such as untreated water, flows through the perforated screen 32 and through the fluid passage 30 into the outer chamber 34 of the injector housing 12. The injector housing 12 also includes an outlet port 36 which provides fluid communication with a resin tank (not shown) of the water treatment system for recharging of the resin.

Figure 2:
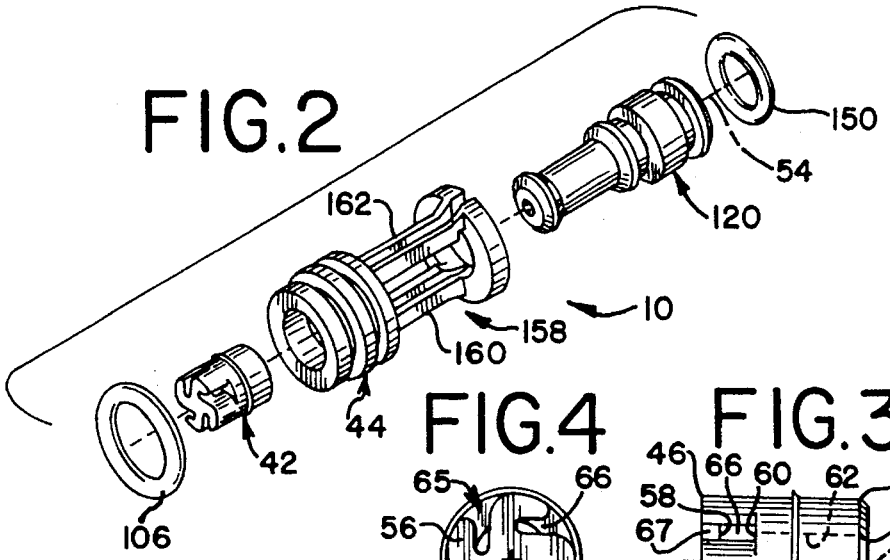
FIG. 2 is an exploded view of the fluid injector assembly.
Figure 4:
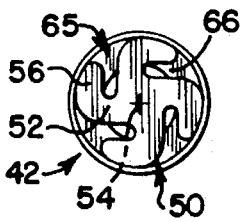
FIG. 4 is an end view of the vortex generator showing the openings of the inlet of the eductor.
Figure 3:
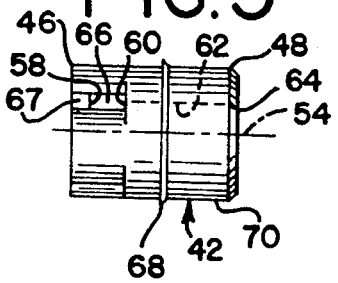
FIG. 3 is a side-elevational view of the vortex generator of the eductor of the fluid injector assembly.
Figure 7:
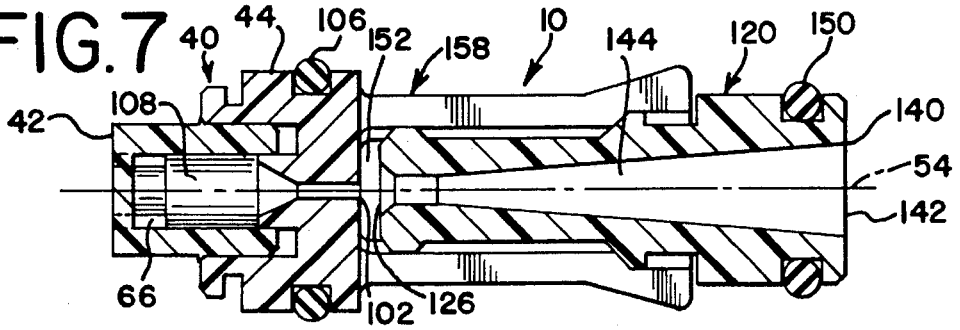
FIG. 7 is a cross-sectional view of the assembled fluid injector assembly.

As best shown in FIGS. 2 and 7, the fluid injector assembly 10 includes an eductor 40 having a vortex generator 42 and a nozzle 44. If desired, the vortex generator 42 and the nozzle 44 may be formed as a single piece. As best shown in FIGS. 3 and 4, the vortex generator 42 includes a first end 46 and a second end 48. The first end 46 includes a plurality of fingers 50. Each finger 50 includes an inner portion 52 which extends generally radially from a longitudinal axis 54 and a outer portion 56 which extends generally transversely to the inner portion 52. The fingers 50 extend along the longitudinal axis 54 between an outer wall 58 and an inner wall 60. A generally cylindrical bore 62 extends concentrically along the longitudinal axis 54 between a port 64 located in the second end 48 of the vortex generator 42 and the outer wall 58 at the first end 46 of the vortex generator 42. The first end 46 of the vortex generator 42 includes an inlet 65 formed by a plurality of tangential openings 66. Each opening 66 is formed between the outer portion 56 of a first finger 50 and the inner portion 52 of a second adjacent finger 50. Each opening 66 is in fluid communication with the cylindrical bore 62 and extends generally tangentially to the cylindrical bore 62. The inlet 65 may also include axial openings 67 which extend through the outer wall 58 such that each opening 67 extends generally parallel to the longitudinal axis 54. A ridge 68 extends generally circumferentially about the outer surface 70 of the vortex generator 42. The outer surface 70 of the tip member 42 is generally cylindrical.

Figure 5:
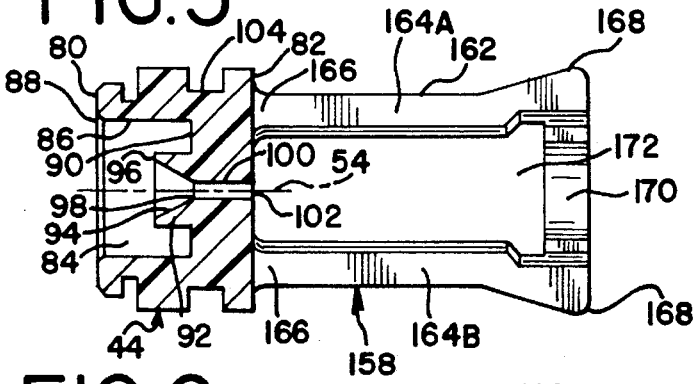
FIG. 5 is a cross-sectional view of the nozzle of the eductor.

As best shown in FIG. 5, the nozzle 44 of the eductor 40 includes a first end 80 and a second end 82. The first end 80 includes a generally cylindrical chamber 84 formed by a cylindrical wall 86. The cylindrical wall 86 extends between a rim 88 and a generally annular wall 90. The cylindrical wall 86 is concentrically located about the axis 54. A generally cylindrical hub 92 projects into the chamber 84 from the annular wall 90 and is concentrically located about the axis 54. The nozzle 44 includes a generally conical bore 94 formed in the cylindrical hub 92 concentrically about the axis 54. The conical bore 94 includes a generally circular first rim 96 at the end of the hub 92 and a spaced apart generally circular second rim 98. The first rim 96 is larger in diameter than the second rim 98 such that the conical bore 94 converges inwardly as it extends from the first rim 96 to the second rim 98. A generally cylindrical bore 100 extends generally concentrically about the axis 54 between the second rim 98 of the conical bore 94 and an outlet port 102 in the second end 82 of the nozzle 44. The diameter of the cylindrical bore 100 is smaller than the diameter of the cylindrical bore 62. The nozzle 44 also includes a generally circular peripheral groove 104 which extends around the nozzle 44. An elastomeric gasket 106, such as an O-ring, as best shown in FIG. 7, is located in the groove 104. The gasket 106 is adapted to form a seal between the nozzle 44 of the eductor 40 and the injector housing 12.

As also best shown in FIG. 7, the second end 48 of the vortex generator 42 is adapted to be inserted into the cylindrical chamber 84 of the nozzle 44 until the ridge 68 of the vortex generator 42 engages the rim 88 of the cylindrical wall 86 of the nozzle 44. The outer surface 70 of the vortex generator 42 fits closely within the cylindrical wall 86 of the nozzle 44. As the second end 48 of the vortex generator 42 is inserted into the cylindrical chamber 84, the cylindrical hub 92 located within the cylindrical chamber 84 projects through the port 64 and into the cylindrical bore 62 of the vortex generator 42. The cylindrical hub 92 fits closely within the cylindrical bore 62 of the vortex generator 42. A fluid passage 108 is thereby provided from the inlet 65 formed by the openings 66 and 67 in the first end 46 of the vortex generator 42, through the cylindrical bore 62 of the vortex generator 42, through the conical bore 94 and cylindrical bore 100 of the nozzle 44, to the outlet port 102. The fluid passage 108 extends generally along the longitudinal axis 54.

Figure 6:
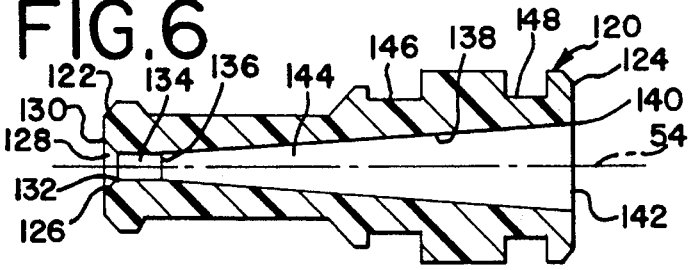
FIG. 6 is a cross-sectional view of the throat of the fluid injector assembly.

The fluid injector assembly 10 also includes a throat 120 as best shown in FIG. 6. The throat 120 includes a first end 122 and a second end 124. An inlet port 126 is formed in the tip of the throat 120 at the first end 122 which is generally concentric with the axis 54. The first end 122 of the throat 120 includes a generally conical bore 128 having a first circular rim 130 which forms the inlet port 126 and a spaced apart second circular rim 132. The second rim 132 is smaller in diameter than the first rim 130 such that the conical bore 128 converges inwardly in the downstream direction of flow from the first rim 130 towards the second rim 132. A generally cylindrical bore 134 extends between the second rim 132 and a circular rim 136. A generally conical bore 138 extends between the rim 136 and a generally circular rim 140. The rim 140 forms an outlet port 142 in the second end 124 of the throat 120. The rim 140 is larger in diameter than the rim 136 such that the conical bore 138 diverges outwardly in the downstream direction of flow from the rim 136 to the rim 140. The conical bore 128, cylindrical bore 134 and conical bore 138 form a fluid passage 144 which extends between the inlet port 126 and outlet port 142 substantially along the longitudinal axis 54. The throat 120 includes a generally circular circumferential groove 146. The throat 120 also includes a generally circular circumferential groove 148 located adjacent the second end 124 of the throat 120. The groove 148 is adapted to receive an elastomeric gasket 150 such as an O-ring as shown in FIG. 7. The central chamber 22 is formed on one side of the gasket 106 between the gaskets 150 and 106, and the outer chamber 34 is formed on the opposite side of the gasket 106. As best shown in FIG. 7, the inlet port 126 and the first end 122 of the throat 120 are spaced apart from the outlet port 102 and second end 82 of the nozzle 44 of the eductor 40 to form a gap 152 therebetween. The gap 152 is in fluid communication with the central chamber 22 and fluid passage 18 of the injector housing 12.

The fluid injector assembly 10 also includes a retention mechanism 158 which retains the throat 120 in spaced relation to the eductor 40. The retention mechanism 158 includes a first leg member 160 and a second leg member 162. Each leg member 160 and 162 includes a first elongate member 164A and a spaced apart second elongate member 164B. Each elongate member 164A and 164B includes a first end 166 which is attached to the second end 82 of the nozzle 44 and a second end 168. A curved rib 170 is attached to and extends between the second ends 168 of the elongate members 164A and 164B of each leg member 160 and 162. The ribs 170 are adapted to seat within the groove 146 on opposing sides of the throat 120 to retain the inlet port 126 of the throat 120 in spaced relation to the outlet port 102 of the eductor 40. An aperture 172 is formed between the elongate members 164A and 164B to facilitate fluid communication between the gap 152 and the outlet port 20 of the fluid passage 18. The leg members 160 and 162 are flexible such that the second end 168 of the first leg member 160 and the second end 168 of the second leg member 162 may be selectively spread apart from one another to disengage the ribs 170 from the throat 120 when desired.

In operation, the fluid injector assembly 10 is located within the injector housing 12 such that the openings 66 and 67 of the inlet 65 are in fluid communication with the outer chamber 34 of the injector housing 12, such that the gap 152 is in fluid communication with the outlet port 20 of the fluid passage 18, and such that the outlet port 142 of the throat 120 is in fluid communication with the outlet port 36 of the injector housing 12. The second fluid flows under pressure from the outer chamber 34 within the injector housing 12 through the tangential openings 66 of the eductor 40 into the fluid passage 108. The tangential openings 66 cause the second fluid to swirl or rotate about the longitudinal axis 54 as it flows through the fluid passage 108 to the outlet port 102. As the swirling second fluid passes through the outlet port 102, the second fluid forms a vortex in the gap 152 having a low pressure zone located between the outlet port 102 of the eductor 40 and the inlet port 126 of the throat 120. The low pressure zone within the gap 152 draws the first fluid located in the central chamber 22 of the injector housing 12 into the gap 152 wherein the first fluid mixes with the second fluid. The mixture of the first fluid and the second fluid within the gap 152 flows into the fluid passage 144 of the throat 120 through the inlet port 126, out of the fluid passage 144 through the outlet port 142, and through the outlet port 36 of the injector housing 12 for use in regenerating the resin within a resin tank.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A fluid injector assembly for drawing a first fluid into the flow of a second fluid, said injector assembly including:

an eductor including an inlet having a plurality of openings, a first outlet port, and a first fluid passage extending between said inlet and said first outlet port, said openings being disposed generally tangential to said first fluid passage, said inlet adapted to be placed in fluid communication with the second fluid such that the second fluid flows through said first fluid passage from said inlet to said first outlet port; and a throat including an inlet port, a second outlet port, and a second fluid passage extending between said inlet port and said second outlet port, said inlet port of said throat being spaced apart from said first outlet port of said eductor thereby forming a gap therebetween, said gap adapted to be placed in fluid communication with the first fluid;

whereby as the second fluid flows through said first fluid passage, said tangential openings of said eductor cause the second fluid to swirl as the second fluid flows out of said first outlet port of said eductor into said gap thereby creating a low pressure zone within said gap which draws the first fluid into said gap wherein the first fluid and the second fluid enter said inlet port of said throat and flow through said second fluid passage.

2. The fluid injector assembly of claim 1 wherein said inlet of said eductor includes a plurality of axial openings.

3. The fluid injector assembly of claim 1 wherein said first fluid passage of said eductor includes a conical bore located between said inlet and said first outlet port, said conical bore converging inwardly in the downstream direction of flow through said first fluid passage.

4. The fluid injector assembly of claim 3 wherein said first fluid passage includes a first cylindrical bore located between said inlet and said conical bore and a second cylindrical bore located between said conical bore and said first outlet port.

5. The fluid injector assembly of claim 1 wherein said second fluid passage of said throat includes a generally conical bore, said conical bore diverging outwardly in the downstream direction of flow through said second fluid passage.

6. The fluid injector assembly of claim 1 including means for retaining said first outlet port of said eductor in spaced relationship with said inlet port of said throat.

7. The fluid injector assembly of claim 6 wherein said means for retaining includes a first leg having a first end attached to said eductor and a second end engaging said throat.

8. The fluid injector assembly of claim 7 wherein said means for retaining includes a second leg having a first end attached to said eductor and a second end engaging said throat, said second end of said first leg and said second end of said second leg engaging opposite sides of said throat.

9. The fluid injector assembly of claim 6 wherein said means for retaining includes a third fluid passage therethrough such that the first fluid flows through said third fluid passage into said gap.

10. The fluid injector assembly of claim 4 wherein said eductor includes a vortex generator and a nozzle, said vortex generator including said openings and said first cylindrical bore and said nozzle including said conical bore and said second cylindrical bore.

11. The fluid injector assembly of claim 1 wherein said first fluid passage and said second fluid passage generally extend along a common longitudinal axis.

* * * * *